US007708878B2

(12) United States Patent
Rosenbaum et al.

(10) Patent No.: US 7,708,878 B2
(45) Date of Patent: May 4, 2010

(54) MULTIPLE SIDE DRAWS DURING DISTILLATION IN THE PRODUCTION OF BASE OIL BLENDS FROM WAXY FEEDS

(75) Inventors: John M. Rosenbaum, Richmond, CA (US); Brent K. Lok, San Francisco, CA (US); Philip E. Quinnett, Gardena, CA (US); Christopher Allen Simmons, Park City, UT (US)

(73) Assignee: Chevron U.S.A. Inc., San Ramon, CA (US)

( * ) Notice: Subject to any disclaimer, the term of this patent is extended or adjusted under 35 U.S.C. 154(b) by 1351 days.

(21) Appl. No.: 11/078,988

(22) Filed: Mar. 10, 2005

(65) Prior Publication Data

US 2006/0201851 A1 Sep. 14, 2006

(51) Int. Cl.
*C10G 45/58* (2006.01)

(52) U.S. Cl. ..... 208/89; 208/93; 208/950; 208/108; 208/19; 585/302

(58) Field of Classification Search ..... 208/89, 208/93, 950, 108, 19; 585/302
See application file for complete search history.

(56) References Cited

U.S. PATENT DOCUMENTS 2,678,263 A * 5/1954 Glazier ..... 208/57
6,096,940 A 8/2000 Wittenbrink et al.
6,332,974 B1 12/2001 Wittenbrink et al.
6,420,618 B1 * 7/2002 Berlowitz et al. ..... 585/310
6,436,278 B1 * 8/2002 Benazzi et al. ..... 208/62
7,144,497 B2 * 12/2006 Lok et al. ..... 208/18
2003/0203982 A1 * 10/2003 Davis et al. ..... 518/719
2004/0079678 A1 * 4/2004 Germaine ..... 208/107

FOREIGN PATENT DOCUMENTS

WO WO 02/070627 A2 9/2002

OTHER PUBLICATIONS

Ernest H. Henderson, Guest Editorial: GTL Base Stocks—How Good Are They?, Gas-To-Liquids News, Jan. 2003, pp. 5 and 7.

* cited by examiner

*Primary Examiner*—Tam M Nguyen
(74) *Attorney, Agent, or Firm*—Susan M. Abernathy

(57) ABSTRACT

A process for producing a product slate, which includes at least three base oil grades having kinematic viscosities at 100° C. within the range between about 1.8 cSt and 30 cSt, from a waxy feed having an initial boiling point of about 340° C. or less and a final boiling point of about 560° C. or higher, said process comprising (a) isomerizing at least a portion of the waxy feed, whereby the amount of isoparaffins present are increased; (b) distilling a first portion of the isomerized waxy feed in light block mode operation into at least three base oil fractions having different boiling ranges; (c) distilling a second portion of the isomerized waxy feed in medium block mode operation into at least three base oil fractions having different boiling ranges; and (d) blending at least one base oil fraction produced from light block mode with at least one base oil fraction produced from medium block mode to produce a lubricating base oil blend meeting a target value for at least one pre-selected property.

29 Claims, 2 Drawing Sheets

Light Block Mode Distillation

Medium Block Mode Distillation

MULTIPLE SIDE DRAWS DURING DISTILLATION IN THE PRODUCTION OF BASE OIL BLENDS FROM WAXY FEEDS

FIELD OF THE INVENTION

The present invention relates to a process scheme for the production of base oil blends prepared from a waxy feed using at least three side draws from the vacuum distillation tower which is operated alternately in light block mode and in medium block mode.

BACKGROUND OF THE INVENTION

Finished lubricants used for automobiles, diesel engines, axles, transmissions, and industrial applications consist of two general components, a base oil and one or more additives. Base oil is the major constituent in these finished lubricants and contributes significantly to the properties of the finished lubricant. In general, a few base oils are used to manufacture a wide variety of finished lubricants by varying the mixtures of individual base oils and individual additives.

Although lubricating base oils traditionally have been prepared from conventional petroleum feedstocks, recent studies have shown that high quality lubricating base oils can be prepared from unconventional waxy feedstocks, such as slack waxes, deoiled slack waxes, refined foots oils, waxy lubricant raffinates, normal paraffin waxes, NAO waxes, waxes produced in chemical plant processes, deoiled petroleum derived waxes, microcrystalline waxes, Fischer-Tropsch waxes, and mixtures thereof. Since these unconventional waxy feedstocks are primarily composed of normal paraffins (n-paraffins), these feedstocks initially have poor low temperature properties, such as pour point and cloud point. In order to improve the low temperature properties of the waxy feedstocks, selective branching must be introduced into the hydrocarbon molecules, as for example, through hydroisomerization. See, for example, U.S. Pat. Nos. 5,135,638; 5,543,035; and 6,051,129.

Base oils are usually prepared from hydrocarbon feedstocks having a major portion boiling above about 340° C. (about 650° F.). Typically, the feedstocks from which lubricating base oils are prepared are recovered as part of the bottoms from an atmospheric distillation unit. This high boiling bottoms material may be further fractionated in a vacuum distillation unit to yield cuts with pre-selected boiling ranges. Most lubricating base oils are prepared from that fraction or fractions where a major portion boils above about 370° C. (about 700° F.) and below about 565° C. (about 1050° F.). In the present invention at least three side draws are collected from the vacuum tower in addition to the heaviest bottoms product and the light overhead. In addition, the vacuum tower is operated alternately in two different block modes, and the products of the side draws are blended in the appropriate proportions to product base oil products having pre-selected properties. The process of the invention offers the flexibility to produce a wide range of base oil products tailored to meet market demand. The process scheme which constitutes the present invention also saves on capital costs by requiring fewer storage tanks at the processing site.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

SUMMARY OF THE INVENTION

The present invention is directed to a process for producing a product slate, which includes at least three base oil grades having kinematic viscosities at 100° C. within the range between about 1.8 cSt and 30 cSt, from a waxy feed having an initial boiling point of about 340° C. (about 650° F.) or less and a final boiling point of about 560° C. (about 1040° F.) or higher, said process comprising (a) isomerizing at least a portion of the waxy feed, whereby the amount of isoparaffins present are increased; (b) distilling a first portion of the isomerized waxy feed in light block mode operation into at least three base oil fractions having different boiling ranges; (c) distilling a second portion of the isomerized waxy feed in medium block mode operation into at least three base oil fractions having different boiling ranges; and (d) blending at least one base oil fraction produced from light block mode with at least one base oil fraction produced from medium block mode to produce a lubricating base oil blend meeting a target value for at least one pre-selected property. Waxy Fischer-Tropsch derived feeds containing at least 40 wt. % n-paraffins have been found to be particularly suitable for use in preparing the base oil blends of the present invention. Preferably, at least three base oil blends will be prepared by blending the base oil fraction produced in light block mode with the base oil fraction produced in medium block mode. In addition to base oil blends, the process of the present invention may also be used to produce a product boiling within the range of diesel. Diesel fuels prepared as part of the product slate usually will have a boiling range between about 65° C. (about 150° F.) and about 400° C. (about 750° F.), typically between about 205° C. (about 400° F.) and about 315° C. (about 600° F.).

The present invention also includes a process scheme for operating a base oil plant for producing base oils from a waxy feed having an initial boiling point of about 340° C. or less and a final boiling point of about 560° C. or higher, said process scheme comprising (a) isomerizing said waxy feed having an initial boiling point of about 340° C. or less and a final boiling point of about 560° C. or higher, whereby the amount of isoparaffins present are increased;

(b) separating the isomerized waxy feed in a vacuum distillation tower, which is alternately operated in a light block mode and in a medium block mode, into at least three base oil fractions having different boiling ranges, whereby at least three grades of base oil are produced in light block mode operation and at least three grades of base oil are produced in medium block mode operation; and (c) blending each grade of base oil produced by the vacuum distillation tower during light block mode operation with the corresponding grade of base oil produced by the distillation tower during medium block mode operation to produce at least three lubricating base oil blends each meeting a target value for at least one pre-selected property. The process scheme is particularly advantageous because it allows the base oil plant to produce pre-selected amounts of one or more grade of base oil. By introducing this flexibility into the operation of the base oil plant the product may be controlled to produce base oil grades to meet current market conditions without the necessity of large capital expenditures for storage tanks.

The present invention is also directed to a base oil slate comprising three or more base oil grades having kinematic viscosities at 100° C. between about 1.8 cSt and about 30 cSt prepared from a waxy feed wherein each of the base oil grades is a base oil blend which comprises (a) between about 0.1 wt. % and about 99.9 wt. % of a distillation fraction prepared in light block mode operation; and (b) between about 0.1 wt. % and about 99.9 wt. % of a distillation fraction prepared in medium block mode operation. The base oil slate will usually contain a base oil blend a having kinematic viscosity at 100° C. within the range from about 1.8 cSt to about 3.5 cSt; a base oil blend a having a kinematic viscosity at 100° C. within the range from about 3.0 cSt to about 6.0 cSt; and a base oil blend a having a kinematic viscosity at 100° C. within the range from about 5.5 cSt to about 15 cSt. The product slate may also include a base oil blend having a kinematic viscosity at 100° C. within the range from about 1.5 cSt to about 3.0 cSt. and a base oil blend having a kinematic viscosity at 100° C. greater than about 10 cSt. As used in this disclosure, the phrase "base oil slate" refers to a collection of different base oil grades recovered from a single distillation tower, usually a vacuum tower.

Finally, the invention is also directed to a base oil slate prepared from a waxy feed, said product slate comprising three or more base oil grades, each base oil grade having a kinematic viscosity at 100° C. between about 1.8 cSt and about 30 cSt and a viscosity index (VI) greater than an amount defined by the equation VI=Ln(Vis100)+95 wherein Ln(Vis100) is the natural log of the viscosity at 100° C.

DETAILED DESCRIPTION OF INVENTION

Figure 1:
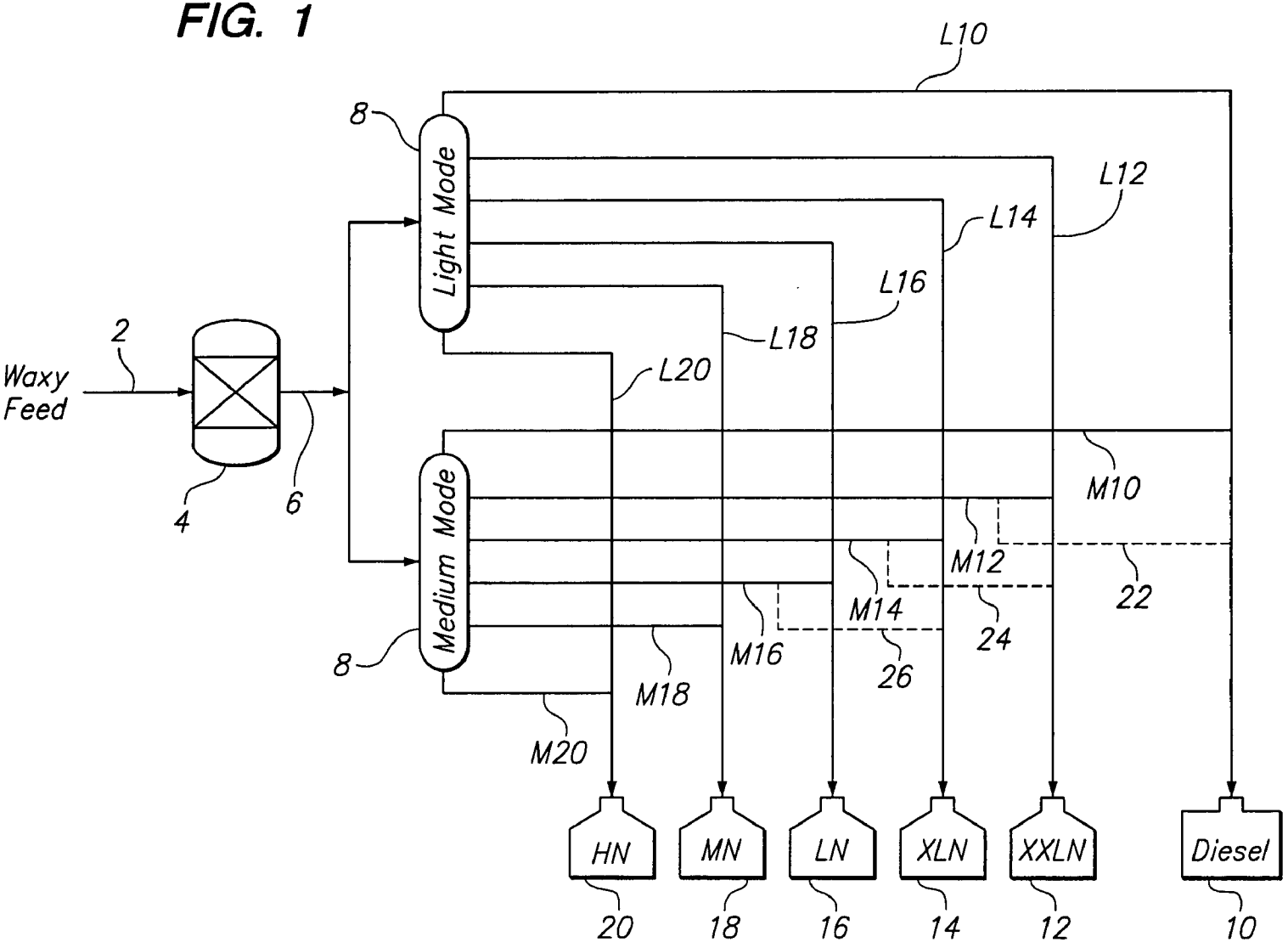
FIG. 1 is a schematic diagram which illustrates the various grades of base oils that may recovered from the vacuum tower when it is operated in light block mode and in medium block mode and the different base oil blends which may be prepared.

The term "waxy feed" as used in this disclosure refers to a feed having a high content of normal paraffins (n-paraffins). A waxy feed useful in the practice of the process scheme of the invention will generally comprise at least 40 wt. % n-paraffins, preferably greater than 50 wt. % n-paraffins, and more preferably greater than 75 wt. % n-paraffins. Preferably, the waxy feed used in the present invention will also have very low levels of nitrogen and sulfur, generally less than 25 ppm total combined nitrogen and sulfur and preferably less than 20 ppm. Examples of waxy feeds that may be used in the present invention include slack waxes, deoiled slack waxes, refined foots oils, waxy lubricant raffinates, n-paraffin waxes, NAO waxes, waxes produced in chemical plant processes, deoiled petroleum derived waxes, microcrystalline waxes, Fischer-Tropsch waxes, and mixtures thereof. The pour points of the waxy feeds used in the practice of this invention are generally greater than about 50° C. and usually greater than about 60° C. The waxy feed which serves as feedstock in the process scheme of the invention is broad boiling. A waxy feed suitable for use in the invention should have an initial boiling point of 340° C. or less and a final boiling point of 530° C. or higher. Preferably the final boiling point of the waxy feed will be greater than about 620° C. (about 1150° F.). Less than about 10 wt. % of the waxy feed will preferably boil below about 260° C. (about 500° F.). Due to the broad boiling range of the waxy feed the difference between the 10 wt. % boiling point and the 90 wt. % boiling will be greater than about 275° C. (about 500° F.).

The nitrogen is measured by melting the wax prior to oxidative combustion and chemiluminescence detection by ASTM D-4629-96. The sulfur is measured by melting the wax prior to ultraviolet fluorescence by ASTM D-5453-00. The test methods for measuring nitrogen and sulfur are further described in U.S. Pat. No. 6,503,956.

Determination of normal paraffins (n-paraffins) in wax-containing samples should use a method that can determine the content of individual $C_7$ to $C_{110}$ n-paraffins with a limit of detection of 0.1 wt. %. The recommended method that was used in determining the data in this disclosure was as follows:

Quantitative analysis of normal paraffins in wax is determined by gas chromatography (GC). The GC (Agilent 6890 or 5890 with capillary split/splitless inlet and flame ionization detector) is equipped with a flame ionization detector, which is highly sensitive to hydrocarbons. The method utilizes a methyl silicone capillary column, routinely used to separate hydrocarbon mixtures by boiling point. The column is fused silica, 100% methyl silicone, 30 meters length, 0.25 mm ID, 0.1 micron film thickness supplied by Agilent. Helium is the carrier gas (2 ml/min) and hydrogen and air are used as the fuel to the flame.

The waxy feed is melted to obtain a 0.1 g homogeneous sample. The sample is immediately dissolved in carbon disulfide to give a 2 wt. % solution. If necessary, the solution is heated until visually clear and free of solids, and then injected into the GC. The methyl silicone column is heated using the following temperature program:

Initial temp: 150° C. (If $C_7$ to $C_{15}$ hydrocarbons are present, the initial temperature is 50° C.)

Ramp: 6° C. per minute

Final Temp: 400° C.

Final hold: 5 minutes or until peaks no longer elute

The column then effectively separates, in the order of rising carbon number, the normal paraffins from the non-normal paraffins. A known reference standard is analyzed in the same manner to establish elution times of the specific normal-paraffin peaks. The standard is ASTM D-2887 n-paraffin standard, purchased from a vendor (Agilent or Supelco), spiked with 5 wt. % Polywax 500 polyethylene (purchased from Petrolite Corporation in Oklahoma). The standard is melted prior to injection. Historical data collected from the analysis of the reference standard also guarantees the resolving efficiency of the capillary column.

If present in the sample, normal paraffin peaks are well separated and easily identifiable from other hydrocarbon types present in the sample. Those peaks eluting outside the retention time of the normal paraffins are called non-normal paraffins. The total sample is integrated using baseline hold from start to end of run. N-paraffins are skimmed from the total area and are integrated from valley to valley. All peaks detected are normalized to 100%. EZChrom is used for the peak identification and calculation of results.

Since the waxy feeds used in the present invention comprise a mixture of varying molecular weights having a wide boiling range, this disclosure will sometimes refer to the 10% point and the 90% point of the respective boiling ranges. The 10% point refers to that temperature at which 10 wt. % of the hydrocarbons present within that cut will vaporize at atmospheric pressure. Similarly, the 90% point refers to the temperature at which 90 wt. % of the hydrocarbons present will vaporize at atmospheric pressure. For samples having a boiling range above about 538° C. (about 1000° F.), the boiling range distributions in this disclosure were measured using the standard analytical method ASTM D-6352 or its equivalent. For samples having a boiling range below 538° C., the boiling range distributions in this disclosure were measured using the standard analytical method ASTM D-2887 or its equivalent. Due to the broad boiling range of the waxy feed the difference between the 10% boiling point and the 90% boiling point usually will be greater than about 275° C. (about 500° F.).

Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into lubricating base oil. Accordingly, Fischer-Tropsch wax represents an excellent feed for preparing high quality base oil blends according to the process of the invention. Fischer-Tropsch wax is normally solid at room temperature and, consequently, displays poor low temperature properties, such as pour point and cloud point. However, following hydroisomerization of the wax, base oils having excellent low temperature properties may be prepared. As used in this disclosure the phrase "Fischer-Tropsch derived" refers to a hydrocarbon stream in which a substantial portion, except for added hydrogen, is derived from a Fischer-Tropsch process regardless of subsequent processing steps. Accordingly, a "Fischer-Tropsch derived waxy feed" refers to a hydrocarbon product containing at least 40 wt. % n-paraffins which was initially derived from the Fischer-Tropsch process.

Slack wax which is also an example of a feed which may be used in the present invention can be obtained from conventional petroleum derived feedstocks by either hydrocracking or by solvent refining of the lube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Optionally, hydrotreating of the slack wax can be used to lower the nitrogen content. Slack waxes possess a very high viscosity index, normally in the range of from about 140 to 200, depending on the oil content and the starting material from which the slack wax was prepared. Therefore, slack waxes are especially suitable for the preparation of lubricating base oils having a very high viscosity index.

Hydroisomerization used in carrying out the process of the invention ideally will achieve high conversion levels of the wax to non-waxy iso-paraffins while at the same time minimizing the conversion by cracking. Preferably, the conditions for hydroisomerization in the present invention are controlled such that the conversion of the compounds boiling above about 370° C. (about 700° F.) in the wax feed to compounds boiling below about 370° C. is maintained between about 10 wt. % and 50 wt. %, preferably between 15 wt. % and 45 wt. %.

According to the present invention, hydroisomerization is conducted using a shape selective intermediate pore size molecular sieve. Hydroisomerization catalysts useful in the present invention comprise a shape selective intermediate pore size molecular sieve and optionally a catalytically active metal hydrogenation component on a refractory oxide support. The phrase "intermediate pore size," as used herein means an effective pore aperture in the range of from about 3.9 Å to about 7.1 Å when the porous inorganic oxide is in the calcined form. The shape selective intermediate pore size molecular sieves used in the practice of the present invention are generally 1-D 10-, 11- or 12-ring molecular sieves. The preferred molecular sieves of the invention are of the 1-D 10-ring variety, where 10- (or 11- or 12-) ring molecular sieves have 10 (or 11 or 12) tetrahedrally-coordinated atoms (T-atoms) joined by an oxygen atom. In the 1-D molecular sieve, the 10-ring (or larger) pores are parallel with each other, and do not interconnect. Note, however, that 1-D 10-ring molecular sieves which meet the broader definition of the intermediate pore size molecular sieve but include intersecting pores having 8-membered rings may also be encompassed within the definition of the molecular sieve of the present invention. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Preferred shape selective intermediate pore size molecular sieves used for hydroisomerization are based upon aluminum phosphates, such as SAPO-11, SAPO-31, and SAPO-41. SAPO-11 and SAPO-31 are more preferred, with SAPO-11 being most preferred. SM-3 is a particularly preferred shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Also preferred shape selective intermediate pore size molecular sieves used for hydroisomerization are zeolites, such as ZSM-22, ZSM-23, ZSM-35, ZSM-48, ZSM-57, SSZ-32, offretite, and ferrierite. SSZ-32 and ZSM-23 are more preferred.

A preferred intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 Å to about 7.1 Å, having a maximum crystallographic free diameter of not more than 7.1 Å and a minimum crystallographic free diameter of not less than 3.9 Å. Preferably the maximum crystallographic free diameter is not more than 7.1 Å and the minimum crystallographic free diameter is not less than 4.0 Å. Most preferably the maximum crystallographic free diameter is not more than 6.5 Å and the minimum crystallographic free diameter is not less than 4.0 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp. 10-15, which is incorporated herein by reference.

A particularly preferred intermediate pore size molecular sieve, which is useful in the present process, is described in U.S. Pat. Nos. 5,135,638 and 5,282,958, the contents of which are hereby incorporated by reference in their entirety. In U.S. Pat. No. 5,282,958 an intermediate pore size molecular sieve is described having a crystallite size of no more than about 0.5 microns and pores with a minimum diameter of at least about 4.8 Å and with a maximum diameter of about 7.1 Å.

The catalyst should have sufficient acidity so that 0.5 grams thereof when positioned in a tube reactor converts at least 50% of hexadecane at 370° C., a pressure of 1200 psig, a hydrogen flow of 160 ml/min, and a feed rate of 1 ml/hr. The catalyst also exhibits isomerization selectivity of 40% or greater (isomerization selectivity is determined as follows: 100×(wt. % branched $C_{16}$ in product)/(weight percent branched $C_{16}$ in product+weight percent $C_{13}$ in product) when used under conditions leading to 96% conversion of normal hexadecane (n-$C_{16}$) to other species.

Such a particularly preferred molecular sieve may further be characterized by pores or channels having a crystallographic free diameter in the range of from about 4.0 Å to about 7.1 Å, and preferably in the range of 4.0 Å to 6.5 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp. 10-15, which is incorporated herein by reference.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al., J. Catalysis 58, 114 (1979); and U.S. Pat. No. 4,440,871, the pertinent portions of which are incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 minutes ($p/p_o$=0.5 at 25° C.). Intermediate pore size molecular sieves will typically admit molecules having kinetic diameters of 5.3 Å to 6.5 Å with little hindrance.

Hydroisomerization catalysts useful in the present invention typically will contain a catalytically active hydrogenation metal. The presence of a catalytically active hydrogenation metal leads to product improvement, especially VI and stability. Typical catalytically active hydrogenation metals include chromium, molybdenum, nickel, vanadium, cobalt, tungsten, zinc, platinum, and palladium. The metals platinum and palladium are especially preferred, with platinum most especially preferred. If platinum and/or palladium is used, the total amount of active hydrogenation metal is typically in the range of 0.1 wt. % to 5 wt. % of the total catalyst, usually from 0.1 wt. % to 2 wt. %.

The refractory oxide support may be selected from those oxide supports, which are conventionally used for catalysts, including silica, alumina, silica-alumina, magnesia, titania and combinations thereof.

The conditions for hydroisomerization will be tailored to achieve a base oil fraction comprising greater than 5 wt. % molecules with cycloparaffinic functionality, and a ratio of weight percent of molecules with monocycloparaffinic functionality to weight percent of molecules with multicycloparaffinic functionality of greater than 15.

The conditions for hydroisomerization will depend on the properties of feed used, the catalyst used, whether or not the catalyst is sulfided, the desired yield, and the desired properties of the lubricant base oil. Conditions under which the hydroisomerization process of the current invention may be carried out include temperatures from about 550° F. to about 775° F. (288° C. to about 413° C.), preferably 600° F. to about 750° F. (315° C. to about 399° C.), more preferably about 600° F. to about 700° F. (315° C. to about 371° C.); and pressures from about 15 psig to 3000 psig, preferably 100 psig to 2500 psig. The hydroisomerization dewaxing pressures in this context refer to the hydrogen partial pressure within the hydroisomerization reactor, although the hydrogen partial pressure is substantially the same (or nearly the same) as the total pressure. The liquid hourly space velocity during contacting is generally from about 0.1 $hr^{-1}$ to 20 $hr^{-1}$, preferably from about 0.1 $hr^{-1}$ to about 5 $hr^{-1}$. Hydrogen is present in the reaction zone during the hydroisomerization process, typically in a hydrogen to feed ratio from about 0.5 MSCF/bbl to 30 MSCF/bbl (thousand standard cubic feet per barrel), preferably from about 1 MSCF/bbl to about 10 MSCF/bbl. Hydrogen may be separated from the product and recycled to the reaction zone. Suitable conditions for performing hydroisomerization are described in U.S. Pat. Nos. 5,282,958 and 5,135,638, the contents of which are incorporated by reference in their entirety.

The vacuum distillation tower used in the process scheme of the invention is alternately operated in light block mode and in medium block mode. As used in this disclosure, the light block mode of operation of the vacuum distillation tower refers to a mode of operation wherein at least three products boiling in the range between 260° C. (500° F.) and 621° C. (1050° F.) or greater are produced and the yield of products having a kinematic viscosity between 5.0 cSt and 15 cSt is less than 17 wt. % (preferably less than 16.5 wt. %), based on the total yield of products out of the vacuum distillation column. In the light block mode the yield of products having a kinematic viscosity between about 3.0 cSt and about 6.0 cSt at 100° C. is greater than the yield of products having a kinematic viscosity between about 5.0 cSt and about 15 cSt at 100° C. In preferred embodiments the difference between the yield of products having a kinematic viscosity between about 3.0 cSt and about 6.0 cSt and the yield of products having a kinematic viscosity between about 5.0 cSt and about 15 cSt is greater than 13 wt. %, preferably greater than 14 wt. %. As used in this disclosure, the medium block mode operation of the vacuum distillation tower refers to a mode of operation wherein at least three products boiling in the range between about 260° C. (500° F.) and about 621° C. (1050° F.) or greater are produced and the yield of products having a kinematic viscosity between about 5.0 cSt and about 15 cSt is greater than about 17 wt. % (preferably greater than about 17.5 wt. %), based on the total yield of products out of the distillation column. The yield of Products having a kinematic viscosity between about 5.0 cSt and about 15 cSt at 100° C. is always higher in the medium block mode than in the light block mode. In preferred embodiments the difference between the yield of products having a kinematic viscosity between about 3.0 cSt and about 6.0 cSt and the yield of products having a kinematic viscosity between about 5.0 cSt and about 15 cSt is less than about 13 wt. %, preferably less than about 12 wt. %.

Usually, the isomerized waxy feeds are also hydrofinished to improve the UV stability and color of the products. It is believed this is accomplished by saturating the double bonds present in the hydrocarbon molecule which also reduces the amount of both aromatics and olefins to a low level. In the present invention, hydroisomerized distillate base oil is preferably sent to a hydrofinisher prior to the blending step. In the present process, the hydrofinishing step may be carried out either prior to the vacuum distillation step or after it. A general description of the hydrofinishing process may be found in U.S. Pat. Nos. 3,852,207 and 4,673,487. As used in this disclosure the term UV stability refers to the stability of the lubricating base oil or other products when exposed to ultraviolet light and oxygen. Instability is indicated when a visible precipitate forms or darker color develops upon exposure to ultraviolet light and air which results in a cloudiness or floc in the base oil.

The total pressure in the hydrofinishing zone typically will be above 500 psig, preferably above 1000 psig, and most preferably will be above 1500 psig. The maximum total pressure is not critical to the process, but due to equipment limitations the total pressure will not exceed 3000 psig and usually will not exceed about 2500 psig. Temperature ranges in the hydrofinishing reactor are usually in the range of from about 150° C. (300° F.) to about 370° C. (700° F.), with temperatures of from about 205° C. (400° F.) to about 260° C. (500° F.) being preferred. The LHSV is usually within the range of from about 0.2 to about 2.0, preferably 0.2 to 1.5 and most preferably from about 0.7 to 1.0. Hydrogen is usually supplied to the hydrofinishing reactor at a rate of from about 1000 SCF per barrel of feed to about 10000 SCF per barrel of feed. Typically the hydrogen is fed at a rate of about 3000 SCF per barrel of feed.

Suitable hydrofinishing catalysts typically contain a Group VIII noble metal component together with an oxide support. Metals or compounds of the following metals are contemplated as useful in hydrofinishing catalysts include ruthenium, rhodium, iridium, palladium, platinum, and osmium. Preferably the metal or metals will be platinum, palladium or mixtures of platinum and palladium. The refractory oxide support usually consists of silica-alumina, silica-alumina-zirconia, and the like. Typical hydrofinishing catalysts are disclosed in U.S. Pat. Nos. 3,852,207; 4,157,294; and 4,673,487.

Base oils recovered from the vacuum distillation tower will include a range of base oils grades. Typical base oil grades recovered from the vacuum tower include, but are not necessarily limited to, XXLN, XLN, LN, MN, and HN. An XXLN grade of base oil when referred to in this disclosure is a base oil having a kinematic viscosity at 100° C. between about 1.5 cSt and about 3.0 cSt, preferably between about 1.8 cSt and about 2.3 cSt. An XLN grade of base oil will have a kinematic viscosity at 100° C. between about 1.8 cSt and about 3.5 cSt, preferably between about 2.3 cSt and about 3.5 cSt. A LN grade of base oil will have a kinematic viscosity at 100° C. between about 3.0 cSt and about 6.0 cSt, preferably between about 3.5 cSt and about 5.5 cSt. An MN grade of base oil will have a kinematic viscosity at 100° C. between about 5.0 cSt and about 15.0 cSt, preferably between about 5.5 cSt and about 10.0 cSt. An HN grade of base oil will have a kinematic viscosity at 100° C. above 10 cSt. Generally, the kinematic viscosity of HN grade of base at 100° C. will be between about 10.0 cSt and about 30.0 cSt, preferably between about 15.0 cSt and about 30.0 cSt. In addition to the various base oil grades, a diesel product may also be recovered from the vacuum tower.

In preparing the base oil blends, target values for one or more properties are pre-selected, and the base oil fractions prepared during operation of the vacuum tower in light block mode and in medium block mode are blended to meet the target value for the selected property or properties. Usually the pre-selected target values will include a value for kinematic viscosity. Other properties which may be selected in preparing the base oil blends include, but are not necessarily limited to, pour point, cloud point, Noack volatility, viscosity index (VI), and cold cranking simulator viscosity (CCS Vis).

Kinematic viscosity, sometimes referred to simply as viscosity, may be measured by ASTM D-445 or its equivalent. Pour point refers to the temperature at which a sample of the base oil begins to flow under carefully controlled conditions. In this disclosure, where pour point is given, unless stated otherwise, it has been determined by standard analytical method ASTM D-5950 or its equivalent. Cloud point is a measurement complementary to the pour point, and is expressed as a temperature at which a sample begins to develop a haze under carefully specified conditions. Cloud point may be determined by ASTM D-5773-95 or its equivalent. Noack volatility is defined as the mass of oil, expressed in weight percent, which is lost when the oil is heated at 250° C. and 20 mmHg (2.67 kPa; 26.7 mbar) below atmospheric in a test crucible through which a constant flow of air is drawn for 60 minutes (ASTM D-5800). A more convenient method for calculating Noack volatility and one which correlates well with ASTM D-5800 is by using a thermo gravimetric analyzer test (TGA) using ASTM D-6375. Viscosity index (VI) may be determined by using ASTM D-2270-93 (1998) or its equivalent. Cold cranching simulator viscosity (CCS Vis) may be determined by using ASTM D-5293-02 or it equivalent. As used herein, an equivalent analytical method to the standard reference method refers to any analytical method which gives substantially the same results as the standard method.

Turning to FIG. 1, the invention will be further illustrated. A waxy feed recovered as the bottoms from a atmospheric distillation tower (not shown) is carried by line 2 to a hydroisomerization reactor 4 were the iso-paraffins in the feed are increased to improve the cold flow properties of the feed. The isomerized waxy feed with a boiling point of about 550° F. or higher is collected from the hydroisomerization or hydrofinishing reactor in line 6 and sent to the vacuum distillation tower 8. Although the figure shows two vacuum towers for clarity, in reality only a single vacuum tower is needed. The vacuum tower is shown as being operated in either light block mode or in medium block mode. The vacuum tower in this embodiment shows four distillation fractions being recovered from the vacuum tower. In addition, a bottoms fraction and an overhead fraction are shown. Six fractions in all are shown being recovered from the vacuum tower. The six fractions are identified as diesel, XXLN, XLN, LN, MN, and HN, respectively.

When operated in light block mode, the six fractions are shown as being collected by lines L10, L12, L14, L16, L18, and L20 and passing to storage tanks 10, 12, 14, 16, 18, and 20, respectively. When operated in medium block mode, the six fractions are shown as being collected by lines M10, M12, M14, M16, M18, and M20 and passing to the same storage tanks 10, 12, 14, 16, 18, and 20, respectively. Depending on market demand, the base oil fractions from the light block and from the medium block mode are blended in various proportions to achieve a target value for one or more properties in the blend. Thus each storage tank receiving a distillate base oil fraction will contain a blend comprising between about 0.1 wt. % and about 99.9 wt. % of a fraction prepared in light block mode and between about 0.1 wt. % and about 99.9 wt. % of a fraction prepared in medium block mode. Also illustrated in the figure are dotted lines 22, 24, and 26 which show that the lighter products produced in medium block mode could alternately be blended with one viscosity grade higher depending on market demand.

It will be noted from the figure that only six storage tanks are necessary to collect all of the products recovered from the vacuum tower and that the process may be used to produce an almost endless array of products having tailored properties. Only the same number of storage tanks are required by this processing scheme as there are draws from the vacuum tower. This flexibility saves on the large capital costs associated with conventional processing schemes which require additional storage tanks.

To build additional flexibility into the distillation process, the vacuum tower may be designed with an extra side draw that lies between the dedicated side draws for the light neutral (LN) and the medium neutral (MN). This intermediate side draw enables on-line blending between either the light neutral or the medium neutral stream. In turn, this ensures more consistent vapor-liquid traffic in the tower when the plant changes operation between the light block mode and the medium block mode. This is illustrated more clearly in FIGS. 2 and 3 which show the operation of the same vacuum tower when operated in the medium block mode and in the light block mode.

Figure 2:
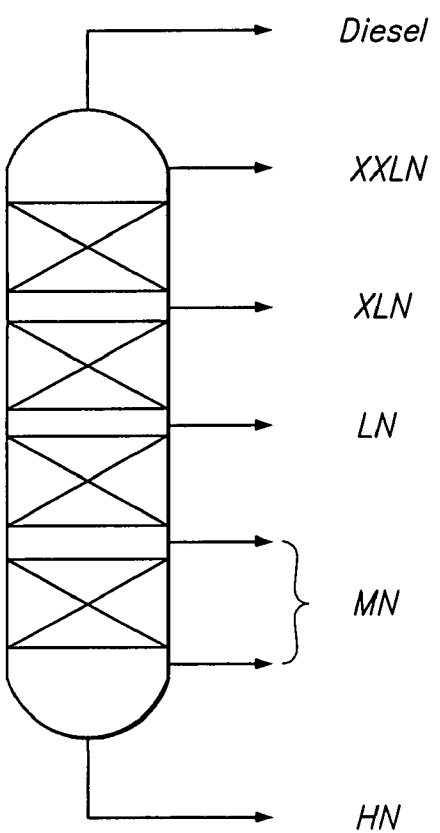
FIG. 2 schematic diagram of a vacuum tower designed for use with the invention which illustrates operation in the medium block mode.

FIG. 2 illustrates the vacuum tower when it is operated in medium block mode. It should be noted that the vacuum tower has five side draws, an overhead for recovery of diesel and a bottoms for recovery of heavy neutral (HN). Three of the side draws are shown as recovering XXLN, XLN, and LN, respectively. The two remaining side draws are both shown as recovering medium neutral base oil (MN). This arrangement allows for additional flexibility when producing medium neutral which is then blended to achieve a specific target viscosity. Accordingly, the operation of the tower may be controlled to produce a medium neutral base oil having a viscosity anywhere within the range of from about 5 cSt to about 15 cSt at 100° C.

Figure 3:
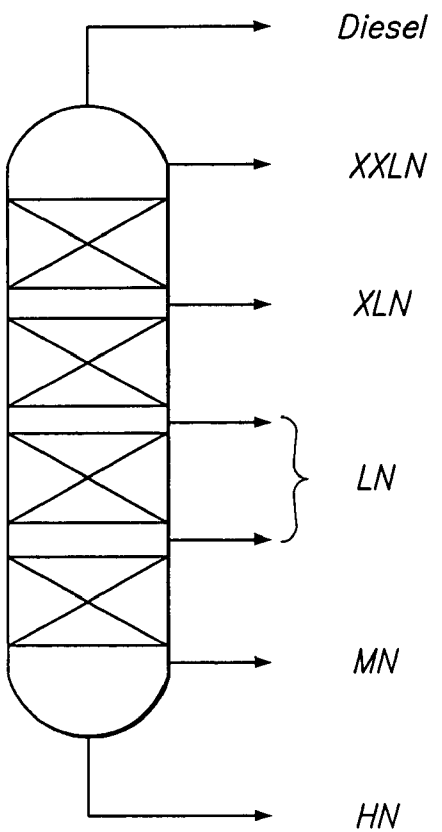
FIG. 3 schematic diagram of a vacuum tower designed for use with the invention which illustrates operation in the light block mode.

Likewise, FIG. 3 illustrates the same vacuum tower as shown in FIG. 2 when it is operated in light block mode. In this instance, three of the side draws represent the recovery of XXLN, XLN, and MN, respectively. The two remaining side draws are shown as both recovering light neutral base oil (LN). This arrangement allows for additional flexibility when producing grades of light neutral which are blended to achieve a specific target viscosity. Accordingly, the operation of the tower may be controlled to produce a light neutral base oil having a viscosity anywhere within the range of from about 3 cSt to about 6 cSt at 100° C.

In one embodiment of this invention, the process for producing the product slate which includes at least three base oil grades may be performed at more than one site. That is, the isomerizing step (and optionally the hydrofinishing step) may be performed at one site separate and remotely located from a second site. In this embodiment the distilling and blending steps may be performed at the second site. The use of a second site for performing complicated vacuum distillations and product tankage may be advantageous where there is limited space for equipment or excessively high construction costs at the first remote site. Specialized sites for distillation and product tankage will generally be located closer to other refineries or markets. The second site may also have lower costs of construction or for shipping of the products to market. In this embodiment the additional step of shipping a broad boiling base oil intermediate having an initial boiling point of about 340° C. or less and a final boiling point of about 560° C. or higher from the first remote site to a second site would require the addition of an intermediate step to the process. The shipping of one broad boiling base oil intermediate may require less capital expense, significantly less space, and less equipment at the first site. This embodiment may be particularly useful with products prepared using the Fischer-Tropsch process, since stranded natural gas is normally located in remote areas far from refineries and markets. A remote location refers to a site which is at least 100 miles distant from the second site.

The following examples will serve to further illustrate the invention but are not intended to be a limitation on the scope of the invention.

EXAMPLES

Example 1

A Fischer-Tropsch wax prepared over a cobalt based catalyst was hydrotreated. Upon analysis the boiling range distribution was found to be as shown in Table 1.

TABLE 1

Fischer-Tropsch Wax Boiling Range Distribution

| D-6352 SIMDIST TBP (wt. %) | ° C. | ° F. |
|---|---|---|
| T0.5 | 295 | 563 |
| T5 | 342 | 648 |
| T10 | 356 | 672 |
| T20 | 380 | 716 |
| T30 | 402 | 755 |
| T50 | 442 | 827 |
| T70 | 488 | 911 |
| T80 | 516 | 961 |
| T90 | 556 | 1032 |
| T95 | 583 | 1082 |
| T95.5 | 632 | 1170 |

A broad boiling base oil was made from the Fischer-Tropsch wax described above by hydroisomerizing it over a Pt/SAPO-11 catalyst and subsequently hydrofinishing it over a Pt/Pd on silica-alumina hydrofinishing catalyst. The broad boiling base oil produced, which has a boiling point of 550° F. or above, was subsequently separated in a vacuum distillation tower operated in a light block mode and a medium block mode. The broad boiling base oil was 78.42 wt. % of the total yield of products out of the hydrofinishing reactor. Both distillation modes produced five fractions. The fractions with the highest cut point range in each of the two modes were distillation bottoms.

The distillation cut point ranges, product yields out of the distillation column (distillation yields), and product properties produced by the two distillation modes are summarized below. Table 2 contains the data from the light block mode distillation, and Table 3 contains the data from the medium block mode distillation.

TABLE 2

Light Block Mode Distillation with Five Fractions

| | Light Block Mode | | | | |
|---|---|---|---|---|---|
| | L1 | L2 | L3 | L4 | L5 |
| Cut Point Range, ° F. | 550-650 | 650-753 | 753-900 | 900-1050 | 1050+ |
| Distillation Yield, wt. % | 18.39 | 29.78 | 30.68 | 15.06 | 6.09 |
| Gravity, °API | 47.6 | 43.9 | 41.6 | 40.0 | 36.2 |
| Pour Point, ° C. | −49 | −30 | −24 | −20 | −2 |
| Viscosity at 100° C., cSt | 1.591 | 2.597 | 4.376 | 7.955 | 21.62 |
| Viscosity Index | — | 125 | 144 | 157 | 158 |
| Noack Volatility, wt. % | 97.4 | 40.0 | 12.0 | 1.4 | 0 |

TABLE 3

Medium Block Mode Distillation with Five Fractions

| | Medium Block Mode | | | | |
|---|---|---|---|---|---|
| | M1 | M2 | M3 | M4 | M5 |
| Cut Point Range, ° F. | 550-650 | 650-748 | 748-880 | 880-1050 | 1050+ |
| Distillation Yield, wt. % | 18.39 | 28.41 | 28.85 | 18.26 | 6.09 |
| Gravity, °API | 47.6 | 44.0 | 41.7 | 40.2 | 36.2 |
| Pour Point, ° C. | −49 | −30 | −25 | −21 | −2 |
| Viscosity at 100° C., cSt | 1.591 | 2.577 | 4.165 | 7.540 | 21.62 |
| Viscosity Index | — | 125 | 142 | 156 | 158 |
| Noack Volatility, wt. % | 97.4 | 40.6 | 13.6 | 1.9 | 0 |

The light block mode of distillation produced a relatively large yield of base oil with a kinematic viscosity at 100° C. of about 4.0 cSt to 4.5 cSt, which would be ideal for blending a 0W grade engine oil. The medium block mode of distillation produced a relatively large yield of base oil with a kinematic viscosity at 100° C. of about 7.5 cSt to 8.0 cSt, which would be ideal for blending a 5W grade engine oil.

Example 2

50/50 blends of the fractions from the two different distillation modes in Example 1 were prepared. The distillation cut point ranges, product yields, and product properties produced by the blends are summarized in Table 4, below.

TABLE 4

50/50 Blended Products with Five Fractions

| | 50/50 Blends | | | | |
|---|---|---|---|---|---|
| | L1 + M1 | L2 + M2 | L3 + M3 | L4 + M4 | L5 + M5 |
| Product Type or Base Oil Grade | Heavy Diesel | XLN | LN | MN | HN |
| Distillation Yield, wt. % | 18.39 | 29.10 | 29.77 | 16.65 | 6.09 |
| Gravity, °API | 47.6 | 43.95 | 41.65 | 40.1 | 36.2 |
| Pour Point, ° C. | −49 | −30 | −24.5 | −20.5 | −2 |
| Viscosity at 100° C., cSt | 1.591 | 2.587 | 4.271 | 7.748 | 21.62 |
| Viscosity Index | — | 125 | 143 | 157 | 158 |
| Noack Volatility, wt. % | 97.4 | 40.3 | 12.8 | 1.7 | 0 |

Note that three of the blended base oil grades in this example had very high VI. The XLN, LN, and MN base oil grades all had a VI greater than the formula 28×Ln(Vis 100)+95.

When transported and blended together in storage tanks, a full base oil slate is produced. The blend of L1 and M1 was a good quality heavy diesel fuel. The other grades were all useful as base oil products that would have high value in the marketplace. The XLN was particularly suitable for making automotive transmission fluid, and LN was particularly suitable for blending 0W engine oil.

Depending on the relative demand for LN or MN grade base oils the proportions of the blends of the light-optimized fractions produced in the light block mode distillation and the medium-optimized fractions produced in the medium block mode distillation could be varied. To accomplish this, the distillation tower would be operated under longer periods of time under one mode rather than the other. One advantage to this process would be that no more storage tanks would be needed, as the blends from either mode could be mixed and stored in the same number of tanks.

In this example the products (heavy diesel and base oils) would be transported, blended together, and stored in five storage tanks. The heavy diesel could be mixed with diesel made by other processes, or stored separately. The four base oils would be a full base oil slate, stored in four base oil storage tanks, one for each base oil grade.

Example 3

The same broad boiling base oil described in Example 1 was separated in a vacuum distillation tower operated in a light block mode and a medium block mode. Each mode produced six, instead of five fractions. As in Example 2, above, the fractions with the highest cut point range in each mode were distillation bottoms fractions.

The distillation cut point ranges, product yields, and product properties produced by the two distillations are summarized below. Table 5 contains the data from the light block mode distillation, and Table 6 contains the data from the medium block mode distillation.

TABLE 5

Light Block Mode Distillation with Six Fractions

| | Light Block Mode | | | | | |
|---|---|---|---|---|---|---|
| | L1 | L2 | L3 | L4 | L5 | L6 |
| Cut Point Range, ° F. | 550-650 | 650-700 | 700-753 | 753-900 | 900-1050 | 1050+ |
| Distillation Yield, Wt. % | 18.39 | 14.30 | 15.48 | 30.68 | 15.06 | 6.09 |

TABLE 5-continued

| Light Block Mode Distillation with Six Fractions | Light Block Mode | | | | | |
|---|---|---|---|---|---|---|
| | L1 | L2 | L3 | L4 | L5 | L6 |
| Gravity, °API | 47.6 | 44.6 | 43.2 | 41.6 | 40.0 | 36.2 |
| Pour Point, ° C. | −49 | −33 | −27 | −24 | −20 | −2 |
| Viscosity at 100° C., cSt | 1.591 | 2.317 | 2.904 | 4.376 | 7.955 | 21.62 |
| Viscosity Index | — | 121 | 129 | 144 | 157 | 158 |
| Noack Volatility, Wt. % | 97.4 | 49.7 | 30.9 | 12.0 | 1.4 | 0 |

TABLE 6

| Medium Block Mode Distillation with Six Fractions | Medium Block Mode | | | | | |
|---|---|---|---|---|---|---|
| | M1 | M2 | M3 | M4 | M5 | M6 |
| Cut Point Range, ° F. | 550-650 | 650-700 | 700-748 | 748-880 | 880-1050 | 1050+ |
| Distillation Yield, Wt. % | 18.39 | 14.30 | 14.11 | 28.85 | 18.26 | 6.09 |
| Gravity, °API | 47.6 | 44.6 | 43.3 | 41.7 | 40.0 | 36.2 |
| Pour Point, ° C. | −49 | −33 | −27 | −24 | −20 | −2 |
| Viscosity at 100° C., cSt | 1.591 | 2.317 | 2.882 | 4.165 | 7.540 | 21.62 |
| Viscosity Index | — | 121 | 128 | 142 | 156 | 158 |
| Noack Volatility, Wt. % | 97.4 | 49.7 | 31.4 | 13.6 | 1.9 | 0 |

As in Example 1 where five distillation fractions were made, the light block mode of distillation where six distillation fractions were made also produced a relatively large yield of base oil with a kinematic viscosity at 100° C. of about 4.0 cSt to 4.5 cSt, which would be ideal for blending a 0W grade engine oil. The medium block mode of distillation produced a relatively large yield of base oil with a kinematic viscosity at 100° C. of about 7.5 cSt to 8.0 cSt, which would be ideal for blending a 5W grade engine oil.

Example 4

50/50 blends of the fractions from the two different distillation modes in Example 3 were prepared. The distillation cut point ranges, product yields, and product properties produced by the blends are summarized in Table 7, below.

TABLE 7

| 50/50 Blended Products with Six Fractions | 50/50 Blends | | | | | |
|---|---|---|---|---|---|---|
| | L1 + M1 | L2 + M2 | L3 + M3 | L4 + M4 | L5 + M5 | L6 + M6 |
| Product Type or Base Oil Grade | Heavy Diesel | XXLN | XLN | LN | MN | HN |
| Distillation Yield, wt. % | 18.39 | 14.30 | 14.80 | 29.77 | 16.66 | 6.09 |
| Gravity, °API | 47.6 | 44.6 | 43.25 | 41.65 | 40 | 36.2 |
| Pour Point, ° C. | −49 | −33 | −27 | −24 | −20 | −2 |
| Viscosity at 100° C., cSt | 1.591 | 2.317 | 2.893 | 4.271 | 7.748 | 21.62 |
| Viscosity Index | — | 121 | 129 | 143 | 156.5 | 158 |
| Noack Volatility, wt. % | 97.4 | 49.7 | 31.2 | 12.8 | 1.65 | 0 |

The process having six blended products produced an additional grade of base oils, an XXLN. The XXLN produced from Fischer-Tropsch wax in this example would be useful as a base oil for making high quality engine oils, power steering fluids, shock absorber fluids, and automatic transmission fluids because it has such a high viscosity index and low Noack volatility. This XXLN would also make a good process or diluent oil.

In this example the products (heavy diesel and base oils) would be transported, blended, and stored in storage tanks. The heavy diesel could be mixed with diesel made by other processes, or stored separately. The five base oils would be a full base oil slate, stored in five base oil storage tanks, one for each base oil grade.

What is claimed is:

1. A process for producing a product slate, which includes at least three base oil grades having kinematic viscosities at 100° C. within the range between about 1.8 cSt and 30 cSt, from a waxy feed having an initial boiling point of about 340° C. or less and a final boiling point of about 560° C. or higher, said process comprising:

(a) isomerizing at least a portion of the waxy feed, whereby the amount of isoparaffins present are increased;

(b) distilling a first portion of the isomerized waxy feed in a light block mode operation into at least three base oil fractions having different boiling ranges;

(c) distilling a second portion of the isomerized waxy feed in a medium block mode operation into at least three base oil fractions having different boiling ranges; and (d) blending at least one base oil fraction produced from the light block mode with at least one base oil fraction produced from the medium block mode to produce a lubricating base oil blend meeting a target value for at least one pre-selected property.

2. The process of claim 1 wherein the final boiling point of the waxy feed is about 620° C. or greater and not more than about 10 wt. % of the waxy feed boils below 260° C.

3. The process of claim 1 wherein the waxy feed contains at least 50 wt. % n-paraffins.

4. The process of claim 1 wherein the waxy feed contains at least 75 wt. % n-paraffins.

5. The process of claim 1 wherein the pour point of the waxy feed is greater than 50° C.

6. The process of claim 5 wherein the pour point of the waxy feed is greater than 60° C.

7. The process of claim 1 wherein at least part of the waxy feed is derived from the product of a Fischer-Tropsch synthesis.

8. The process of claim 1, wherein the blending step comprises blending at least three base oil fractions produced from the light block mode with at least three base oil fractions produced from the medium block mode to make at least three lubricating base oil blends.

9. The process of claim 1 wherein the product slate contains at least one lubricating base oil blend having a kinematic viscosity at 100° C. within the range from about 1.5 cSt to about 3.0 cSt.

10. The process of claim 1 wherein the product slate contains at least one lubricating base oil blend having a kinematic viscosity at 100° C. within the range from about 1.8 cSt to about 3.5 cSt.

11. The process of claim 1 wherein the product slate contains at least one lubricating base oil blend having a kinematic viscosity at 100° C. within the range from about 3.0 cSt to about 6.0 cSt.

12. The process of claim 1 wherein the product slate contains at least one lubricating base oil blend having a kinematic viscosity at 100° C. within the range from about 5.0 cSt to about 15 cSt.

13. The process of claim 1 wherein the product slate contains at least one lubricating base oil blend having a kinematic viscosity at 100° C. greater than about 10 cSt.

14. The process of claim 8 wherein the at least three lubricating base oil blends have a VI of 120 or higher.

15. The process of claim 1 wherein the product slate also includes a diesel product.

16. The process of claim 1 wherein the target value is for kinematic viscosity.

17. The process of claim 1 wherein step (a) of the process is performed at a first site and steps (b) and (c) are performed at a second site, wherein said first site is remotely located from the second site.

18. A process scheme for operating a base oil plant for producing base oils from a waxy feed, said process scheme comprising:

(a) isomerizing a waxy feed having an initial boiling point of about 340° C. or less and a final boiling point of about 560° C. or higher, whereby the amount of isoparaffins present are increased;

(b) separating the isomerized waxy feed in a vacuum distillation tower, which is alternately operated in a light block mode and in a medium block mode, into at least three base oil fractions having different boiling ranges, whereby at least three grades of base oil are produced in the light block mode operation and at least three grades of base oil are produced in the medium block mode operation; and (c) blending each grade of base oil produced by the vacuum distillation tower during light block mode operation with the corresponding grade of base oil produced by the distillation tower during medium block mode operation to produce at least three lubricating base oil blends each meeting a target value for at least one pre-selected property.

19. The process of claim 18 wherein the waxy feed is derived from a Fischer-Tropsch synthesis.

20. The process scheme of claim 18 wherein the period of time in which the vacuum distillation tower is operated in the light block mode and in medium block mode is controlled in order to produce pre-selected amounts of at least one grade of base oil.

21. The process scheme of claim 18 wherein at least four base oil fractions are produced in the light block mode and four base oil fractions are produced in medium block mode and at least four lubricating base oil blends are produced from said base oil fractions.

22. The process scheme of claim 21 wherein at least five base oil fractions are produced in the light block mode and five base oil fractions are produced in medium block mode and at least five lubricating base oil blends are produced from said base oil fractions.

23. The process scheme of claim 18 wherein a diesel product is also recovered from the vacuum tower.

24. The process scheme of claim 18 wherein at least one lubricating base oil blend has a kinematic viscosity at 100° C. within the range from about 1.5 cSt to about 3.0 cSt.

25. The process scheme of claim 18 wherein at least one lubricating base oil blend has a kinematic viscosity at 100° C. within the range from about 1.8 cSt to about 3.5 cSt.

26. The process of claim 18 wherein at least one lubricating base oil blend has a kinematic viscosity at 100° C. within the range from about 3.0 cSt to about 6.0 cSt.

27. The process of claim 18 wherein at least one lubricating base oil blend has a kinematic viscosity at 100° C. within the range from about 5.5 cSt to about 15 cSt.

28. The process of claim 18 wherein at least one lubricating base oil blend has a kinematic viscosity at 100° C. greater than about 10 cSt.

29. The process of claim 18 wherein at least three of the base oil blends have a VI of 120 or higher.

* * * * *